US005395214A

United States Patent [19]

Kawahara et al.

[11] Patent Number: 5,395,214

[45] Date of Patent: Mar. 7, 1995

[54] STARTING METHOD FOR SCROLL-TYPE COMPRESSOR

[75] Inventors: Sadao Kawahara, Otsu; Michio Yamamura, Kusatsu; Jiro Yuda, Ikoma; Yoshinori Kojima, Kusatsu; Shuichi Yamamoto, Otsu; Manabu Sakai, Toyonaka; Shigeru Muramatsu, Kusatsu; Osamu Aiba, Kusatsu; Shiro Maeda, Kusatsu, all of Japan

[73] Assignee: Matsushita Electric Industrial Co., Ltd., Osaka, Japan

[21] Appl. No.: 720,786

[22] PCT Filed: Nov. 2, 1990

[86] PCT No.: PCT/JP90/01423

§ 371 Date: Sep. 3, 1991

§ 102(e) Date: Sep. 3, 1991

[87] PCT Pub. No.: WO91/06775

PCT Pub. Date: May 16, 1991

[30] Foreign Application Priority Data

Nov. 2, 1989 [JP] Japan ..... 1-287021

[51] Int. Cl.[6] ..... F04C 18/02

[52] U.S. Cl. ..... 417/53; 417/540; 417/410.5; 418/1; 418/55.1

[58] Field of Search ..... 418/1, 55.1, 270; 417/53, 540, 410 D

[56] References Cited

U.S. PATENT DOCUMENTS

| | | | |
|---|---|---|---|
| 4,383,805 | 5/1983 | Teegarden et al. | 418/55.1 X |
| 4,545,747 | 10/1985 | Tamura et al. | 418/55.1 |
| 4,759,696 | 7/1988 | Ishiai | 418/55.1 |
| 5,055,012 | 10/1991 | Sakashita et al. | 418/55.1 X |
| 5,141,420 | 8/1992 | Nambiar | 418/55.1 |

FOREIGN PATENT DOCUMENTS

| | | |
|---|---|---|
| 575592 | 1/1982 | Japan . |
| 61-213556 | 9/1986 | Japan . |

*Primary Examiner*—Richard E. Gluck

*Attorney, Agent, or Firm*—Stevens, Davis, Miller & Mosher

[57] ABSTRACT

An outlet check valve includes an output valve seat provided at an outlet port or an outlet passage for compressed air in the vicinity of an outlet port of a compression mechanism and an outlet valve body. The valve seat and valve body are biased away from each other by a gravitational force or a spring. With this arrangement, even if a compressor is rotated at a low speed during a start-up operation, it is possible to cause stagnant liquid to undergo reverse flow into an accumulator disposed on the suction side and to store the liquid temporarily, thereby removing the liquid in the compression spaces and the suction passages and facilitating the start-up operation in a normal rotational direction. A pressure difference between the pressures upstream and downstream relative to the valve body is large when the normal rotating operation is stopped. By this pressure difference, the outlet valve body is moved to close the outlet valve seat, thereby to prevent the reverse rotation of the compression mechanism.

2 Claims, 2 Drawing Sheets

STARTING METHOD FOR SCROLL-TYPE COMPRESSOR

TECHNICAL FIELD

The present invention relates to a starting method for a scroll-type compressor of a refrigerator.

BACKGROUND ART

Japanese Patent Unexamined Publication No. 61-213556 (entitled "STARTING METHOD FOR COMPRESSION TYPE REFRIGERATOR") is referenced as a conventional example relating to a starting method for a compressor. In a refrigerator provided with a compressor such as a scroll-type compressor in which a direction of flow of gas is reversed by reversing a rotational direction of a drive shaft, it is difficult to rotate the drive shaft in a normal forward direction because of a large amount of coolant liquid which collects and becomes stagnant in the compressor when the refrigerator is off. However, the publication discloses a technique wherein the compressor is first rotated in the direction opposite to the normal direction at the start-up to discharge the liquid in the compressor mechanism, thereby avoiding both the starting difficulty of the compressor and damage to the compressor. This published patent points out two common phenomena to be avoided by the embodiments thereof. First, the compressor when rotated in the reverse direction generates noise when the normal operation is stopped. Second, a check valve or the like, which is generally provided on the suction side for coping with a problem such as stagnation of a part of the oil in the suction passage, would hinder the first reverse rotation of this starting method. The publication discloses a method for dispensing with the check valve, which would otherwise hinder the reverse rotation in the starting period, by switching a four-way valve into a reverse mode when the refrigerator is stopped from the normal operating condition.

In the above-described conventional starting method of the refrigerator, it is necessary to provide the four-way valve and a mechanism for switching over the four-way valve when the compressor is stopped. Upon switching over the four-way valve, a large reverse flow noise and collision would be generated. Depending upon the operating condition of the refrigerator, there is a risk that the compressor would start the reverse rotation to generate noise until the pressures are stabilized at respective parts of the refrigerator after the four-way valve of the compressor has been switched. In addition, in the case of a refrigerator without any four-way valve, it is necessary to provide an electromagnetic valve instead of the four-way valve, which increases the total cost of the refrigerator.

DISCLOSURE OF THE INVENTION

In order to solve the problems inherent in a starting method of the conventional refrigerator described above, according to a first embodiment, there is provided a method for starting a scroll-type compressor, comprising the steps of: providing a compressor with an electric motor, a compressor mechanism driven by the motor, and an accumulator for temporarily storing a large amount of liquid at a suction passage of the compressor; positioning an outlet check valve in the suction passage or in an outlet passage of compressed gas at an outlet port or its vicinity of the compressor mechanism, the check valve including an outlet valve seat and an outlet valve body for opening/closing the outlet valve seat, the valve seat and valve body being biased away from each other by a gravitational force or a spring, and wherein a passage for the outlet gas is formed around the outlet valve body; providing the compressor mechanism with a stationary spiral vane part having a stationary spiral vane on a stationary end plate, a swirl spiral vane part having a swirl spiral vane on a swirl end plate in engagement with the stationary spiral vane for forming a plurality of compressor working spaces, a revolution restricting part for preventing the swirl spiral vane part from rotating about its own axis but allowing it to undergo a swirl motion, and a crank shaft for driving the spiral vane part to cause the swirling motion; temporarily rotating the compressor in a reverse direction opposite to the normal forward direction at a rotating speed lower than a standard rotational speed of the compressor at the start-up of the refrigerator; and thereafter rotating the compressor in a normal forward direction.

In order to solve the problems of the prior art, according to a second embodiment, there is provided a method for starting a scroll-type compressor, comprising the steps of: providing a compressor with an electric motor, a compressor mechanism driven by the motor and an accumulator for temporarily storing a large amount of liquid at the compressor; positioning a suction check valve in a suction port of the compression mechanism or a suction passage of the refrigerator provided with the compressor or at a suction passage upstream of the suction check valve of the refrigerator provided with the compressor, the suction check valve having a suction valve seat and a suction valve body for opening/closing the suction valve seat which are biased away from each other by a gravitational force or a spring, and in which a passage for the suction gas is formed around the suction valve body; providing the compressor mechanism with a stationary spiral vane part having a stationary spiral vane on a stationary end plate, a swirl spiral vane part having a swirl spiral vane on a swirl end plate in engagement with the stationary spiral vane for forming a plurality of compressor working spaces, a revolution restricting part for preventing the swirl spiral vane part from rotating about its own axis but allowing it to undergo a swirl motion, and a crank shaft for driving the spiral vane part to undergo the swirl motion; temporarily rotating the compressor in a reverse direction opposite to the normal forward direction at a rotating speed lower than a standard rotational speed of the compressor at the start-up of the compressor mechanism; and thereafter rotating the compressor in a normal forward direction.

BEST MODE FOR CARRYING OUT THE INVENTION

Figure 1:
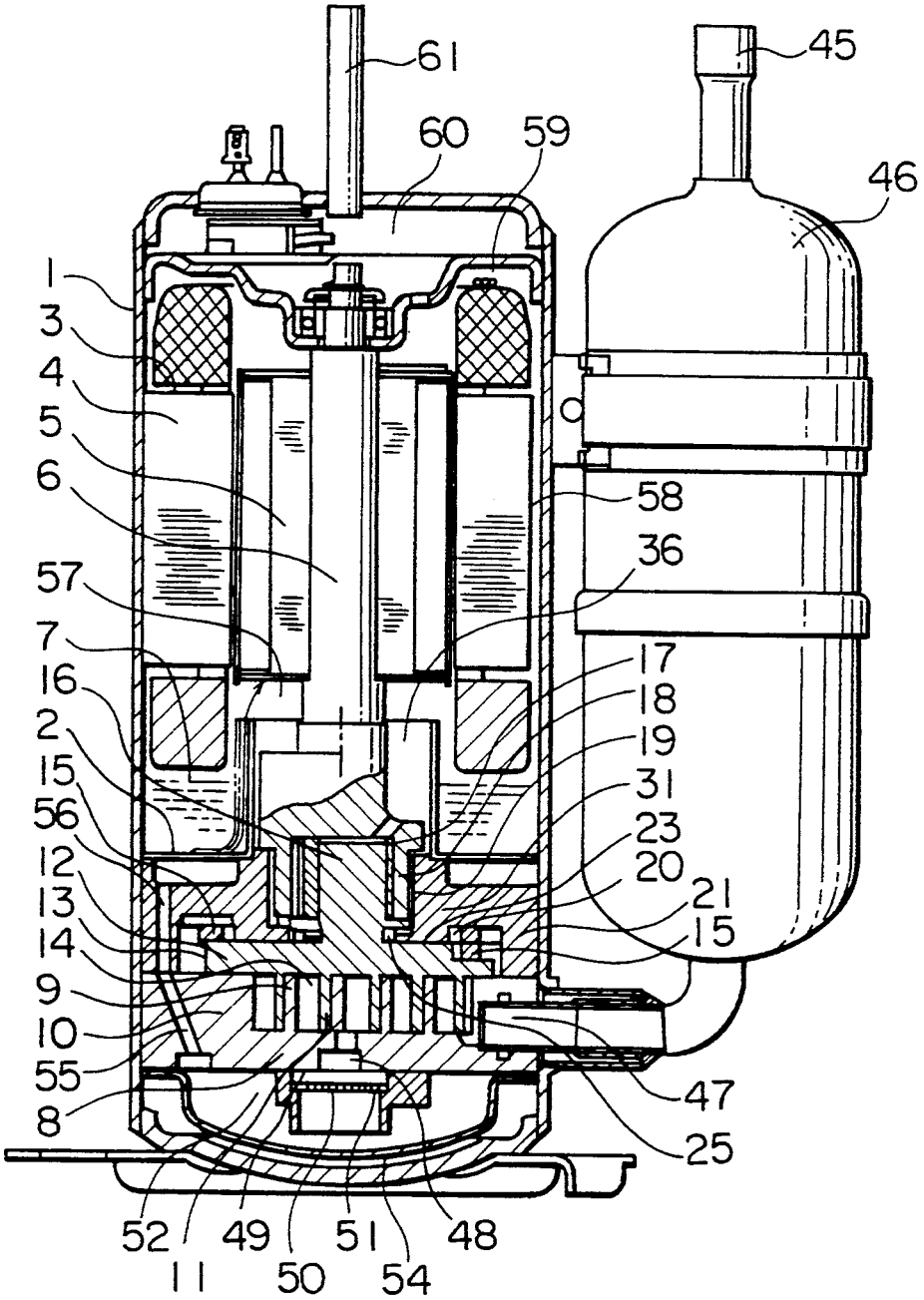
FIG. 1 is a partial cross-sectional view showing a starting method for a scroll-type compressor in accordance with a first embodiment of the invention.
Figure 2:
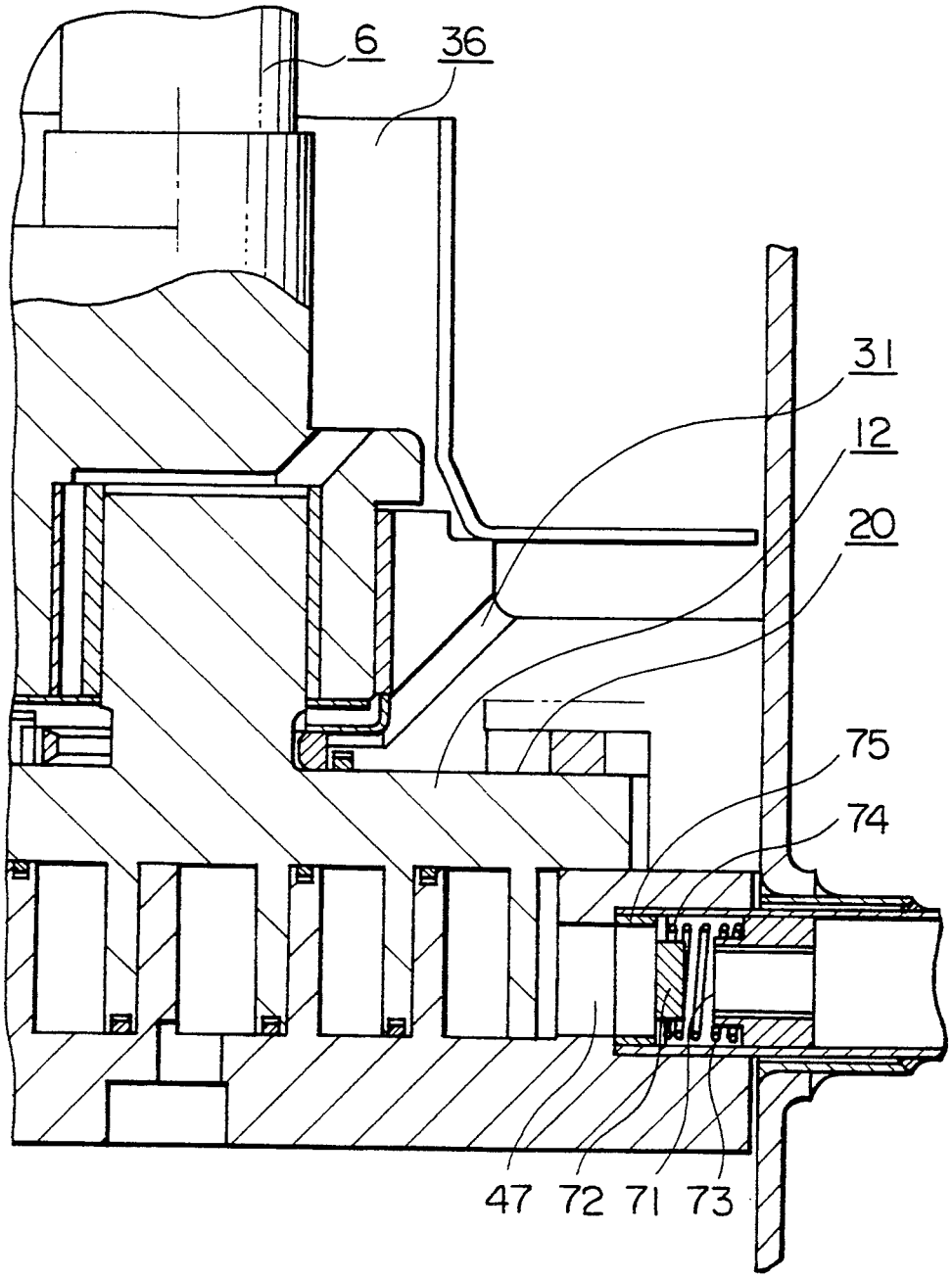
FIG. 2 is a cross-sectional view of a primary part showing a starting method for a scroll-type compressor in accordance with a second embodiment of the invention.

FIG. 1 is a cross-sectional view showing a compressor in accordance with the first embodiment of the invention. FIG. 2 is an enlarged view showing a suction check valve portion in accordance with the second embodiment. A compression mechanism 2 is fixed to a lower portion of an interior of a sealed container 1. A stator 4 of an electric motor 3 for driving the compression mechanism is fixed to an upper portion thereof. A crank shaft 6 for driving the compression mechanism 2 is coupled with a rotor 5 of the motor 3. A lubricant oil pan 7 is formed around the compression mechanism 2 at the lower portion of the container 1. The compression mechanism 2 includes a stationary spiral vane part 10 having a stationary spiral vane 9 formed integrally with a stationary end plate 8, a swirl spiral vane part 13 in which a swirl spiral vane 11, for forming a plurality of compression working spaces 14 in engagement with the stationary spiral vane 9, is formed on a swirl end plate 12, a revolution restrictor 15 for preventing the swirl spiral vane part 13 from revolving about its own axis but allowing it to undergo a swirling motion, a swirl drive shaft 16 provided on a side of the swirl end plate 12 opposite to the spiral vane 11, an eccentric bearing 17 which is provided on the inside of a main shaft 18 of the crank shaft 6 and into which is inserted the swirl drive shaft 16, a bearing part 21 having a main bearing 19 for supporting the main shaft 18 of the crank shaft 6, and an end plate movement restricting surface 23 for limiting an axial movement of the swirl spiral vane part 13 at a fine gap from a swirl end plate back surface 20 of the swirl end plate 12. An oil pump cylindrical inner wall is formed between the main shaft 18 of the crank shaft 6 and the swirl end plate back surface 20; one end of the oil pump cylindrical inner wall is closed by the swirl end plate back surface 20, and the other end is closed by an end plate of the oil pump, thereby forming an oil pump. The lubricant oil in the lubricant oil pan is sucked from an oil suction passage 31 to the oil pump and is introduced from an oil outlet into the oil outlet chamber 32. The lubricant oil in the oil outlet chamber 32 is applied to the main bearing 19 for lubrication, and thereafter is discharged into a balance weight chamber 36. The other part of the lubricant oil in the oil outlet chamber 32 is applied to the eccentric bearing 17 for lubrication and is thereafter discharged into the balance weight chamber 36. An annular sealing strip, which partitions the gap between the end plate movement restricting surface 23 and the swirl end plate back surface 20 into a surface to which the outlet pressure on the oil pump side is applied and a surface to which a pressure lower than that of the outer peripheral portion is applied, is slidably disposed relative to the swirl end plate back surface 20 on the end plate movement restricting surface 23.

The coolant gas sucked from a suction pipe 45 of the compressor is introduced through an accumulator 46 from a suction inlet 47 of the compression mechanism 2 and compressed in the compression working spaces 14. It then passes from downwardly formed outlet port 48 through an outlet check valve 52 which includes an outlet valve seat 49 formed at the outlet 48, an outlet valve body 50 confronted at an interval with the outlet valve seat 49, and an outlet check valve 52 formed with an outlet check valve passage 51 around the outlet valve body 50. It then passes through an interior of the outlet muffler 54, an outlet passage 55 provided in the stationary end plate 8 and an outlet passage 56 formed in the bearing part 21, and is discharged into an outlet chamber 57 disposed below the motor 3 and between the motor 3 and the compressor 2. The discharged coolant gas is passed from a peripheral passage 58 of the motor through an upper discharge chamber 59 of the motor to cool the motor 3 and is thereafter introduced from an outlet pipe 61 to the outside of the motor.

For instance, when the refrigerator is stopped for a long period of time, a large amount of coolant liquid and the lubricant oil are stagnant within the compressor. Under this condition, the compressor is rotated at a low speed in a reverse direction opposite to the normal direction of rotation, so that the liquid within the compressor is caused to flow from the outlet check valve to the compressor mechanism. However, the velocity of the liquid through the outlet check valve passage 51 around the outlet valve body 50 is not large, so that a generated pressure loss is not high enough to press the outlet valve body 50 to the outlet valve seat 49 against the gravitational force. For this reason, the reverse flow within the compressor due to the reverse rotation will be continued. The liquid which has undergone the reverse flow from the compressor mechanism is stored in the accumulator 46.

FIG. 2 shows a partial view showing a compressor according to the second embodiment which dispenses with the outlet check valve 52 composed of the outlet valve seat 49, the outlet valve body 50 and the outlet check valve passage 51. A suction check valve 70 is interposed in the suction port 47 of the compressor 2 from the accumulator 46. The suction check valve 70 is composed, on the accumulator 46 side, of a suction valve seat 71, a suction valve body 72, a suction check valve spring 73 for urging the suction valve body 72 away from the suction valve seat 71, a suction check valve passage 74 formed around the suction valve body 72, a suction valve body restricting piece 75 for limiting the excessive movement of the suction valve body and the like.

INDUSTRIAL APPLICABILITY

As described above, the effects of the invention are that, in a refrigerator having a scroll-type compressor, the compressor can be readily started by using a check valve having an improved structure even if the four-way valve is not used, and it is unnecessary to connect the four-way valve, if used, to the reverse side through a complicated method when the normal operation of the refrigerator is stopped, thus providing a reliable starting method which is simple and low in cost.

We claim:

1. A method of starting a scroll-type compressor of a refrigerator, the method comprising:

(a) providing the refrigerator with the scroll-type compressor and a suction passage, the suction passage comprising an accumulator for temporarily storing liquid, the compressor comprising a sealed container, an electric motor disposed within the sealed container, and a compressor mechanism disposed within the sealed container and driven by the electric motor, the compressor mechanism comprising (i) a stationary spiral vane part having a stationary end plate and a stationary spiral vane on the stationary end plate, (ii) a swirl spiral vane part having a swirl end plate and a swirl spiral vane on the swirl end plate for engaging with the stationary spiral vane to define a plurality of compressor working spaces, (iii) a revolution restricting means for preventing the swirl spiral vane part from rotating on an axis of the swirl spiral vane part and for allowing the swirl spiral vane part to perform a swirling motion, (iv) a crank shaft for driving the swirl spiral vane part in the swirling motion, (v) an outlet port, and (vi) an outlet valve disposed in the outlet port, the outlet valve comprising an outlet valve seat and an outlet valve body, the outlet valve body serving to open and close the outlet valve;

(b) biasing the outlet valve body by a gravitational force in a direction in which the outlet valve body and the outlet valve seat are spaced from each other to form an outlet passage for outlet gas around the outlet valve body;

(c) rotating the compressor mechanism at a rotational speed which is lower than a standard rotational speed of the compressor mechanism and in a rotational direction opposite to a normal rotational direction of the compressor mechanism; and (d) thereafter rotating the compressor mechanism in the normal rotational direction.

2. A method as in claim 1, wherein step (c) comprises setting the rotational speed which is lower than the standard rotational speed of the compressor such that a coolant liquid which is caused to flow into the compressor mechanism when the compressor mechanism is rotated in the rotational direction opposite to the normal rotational direction of the compressor does not exert sufficient pressure to close the outlet valve against the gravitational force; whereby the outlet valve remains open during step (c).

* * * * *